US009145631B2

(12) United States Patent
Kawai

(10) Patent No.: US 9,145,631 B2
(45) Date of Patent: Sep. 29, 2015

(54) BUTTONHOLE SWITCH MECHANISM

(71) Applicant: AISIN SEIKI KABUSHIKI KAISHA, Kariya-shi (JP)

(72) Inventor: Yasunori Kawai, Nagoya (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 303 days.

(21) Appl. No.: 13/727,073

(22) Filed: Dec. 26, 2012

(65) Prior Publication Data

US 2013/0160686 A1 Jun. 27, 2013

(30) Foreign Application Priority Data

Dec. 26, 2011 (JP) ..... 2011-283091

(51) Int. Cl.
*D05B 3/00* (2006.01)
*D05B 19/12* (2006.01)
*D05B 3/14* (2006.01)

(52) U.S. Cl.
CPC . *D05B 19/12* (2013.01); *D05B 3/14* (2013.01)

(58) Field of Classification Search
CPC ..... D05B 3/06; D05B 3/22; D05B 3/00; D05B 3/04; D05B 3/08
See application file for complete search history.

(56) References Cited

U.S. PATENT DOCUMENTS 3,233,569 A * 2/1966 Eguchi ..... 112/77
3,841,246 A * 10/1974 Casner et al. ..... 112/77
3,877,403 A * 4/1975 Ketterer ..... 112/77
4,181,087 A * 1/1980 Brauch et al. ..... 112/475.25
4,182,249 A * 1/1980 Matumura et al. ..... 112/447
4,343,249 A * 8/1982 Takenoya et al. ..... 112/456
4,604,958 A 8/1986 Busch et al.
4,953,486 A * 9/1990 Sano et al. ..... 112/447
5,564,355 A * 10/1996 Watson ..... 112/235
5,899,157 A * 5/1999 Kurono et al. ..... 112/470.01

(Continued)

FOREIGN PATENT DOCUMENTS

DE 10 2008 027 015 A1 12/2008
GB 533183 2/1941

(Continued)

OTHER PUBLICATIONS

Extended European Search Report issued on May 7, 2013 in the corresponding European Application No. 12199345.5.

*Primary Examiner* — Danny Worrell
*Assistant Examiner* — Megan Brandon
(74) *Attorney, Agent, or Firm* — Oblon, McClelland, Maier & Neustadt, L.L.P.

(57) ABSTRACT

Provided is a buttonhole switch mechanism of a buttonhole sewing machine including a buttonhole presser mounted on a lower end of a presser bar of the sewing machine and having a presser frame, a buttonhole switch mechanism disposed on an arm section of the sewing machine, a feed dog disposed below the buttonhole presser to move cloth, a sewing needle forming stitches in the cloth with vertical movement, a controller performing control on the movement of the feed dog and the sewing needle, a fixing member fixed to a non-movable part of a sewing machine main body, a mount supported so as to be movable in the front-and-rear direction with respect to the fixing member, an adjustment mechanism adjusting and fixing the relative positions of the fixing member and the mount in the front-and-rear direction, a lever member supported by a rotary shaft provided at the mount, and the detection switch fixed to the mount.

4 Claims, 12 Drawing Sheets

(56) References Cited

U.S. PATENT DOCUMENTS

| | | | | |
|---|---|---|---|---|
| 6,223,664 | B1 * | 5/2001 | Gamano et al. | 112/73 |
| 2003/0226486 | A1 * | 12/2003 | Filges et al. | 112/65 |
| 2005/0103245 | A1 * | 5/2005 | Fischer et al. | 112/68 |
| 2008/0006191 | A1 * | 1/2008 | Asaba et al. | 112/65 |
| 2008/0066665 | A1 * | 3/2008 | Asaba et al. | 112/470.03 |
| 2008/0264318 | A1 * | 10/2008 | Mori | 112/470.03 |
| 2010/0071604 | A1 * | 3/2010 | Kinoshita | 112/235 |
| 2010/0212561 | A1 * | 8/2010 | Nakashima et al. | 112/2 |
| 2012/0210923 | A1 * | 8/2012 | Tseng | 112/235 |

FOREIGN PATENT DOCUMENTS

| | | |
|---|---|---|
| JP | 8-141235 | 6/1996 |
| JP | 2008-12052 | 1/2008 |
| JP | 2010-227391 | 10/2010 |

* cited by examiner

UP
DOWN
FRONT
REAR
X1
X2
STATE (a)
STATE (b)
STATE (c)
A1
B1
C1
1
25
23
26
24
3
3a
7
5
72a
22
24a
21
71a
21b
B

BUTTONHOLE SWITCH MECHANISM

CROSS REFERENCE TO RELATED APPLICATIONS

This application is based on and claims priority under 35 U.S.C. §119 to Japanese Patent Application 2011-283091, filed on Dec. 26, 2011, the entire content of which is incorporated herein by reference.

TECHNICAL FIELD

This disclosure relates to a buttonhole switch mechanism of a buttonhole sewing machine.

BACKGROUND DISCUSSION

In sewing machines that can perform buttonhole sewing, it is necessary to change the sewing length of a buttonhole according to the diameter of a button. For example, computer sewing machines disclosed in JP 2010-227391A (Reference 1), JP 8-141235A (Reference 2), and JP 2008-12052A (Reference 3) have a detection mechanism that detects the diameter of a button, and are adapted to be able to automatically move cloth that becomes an object to be sewn according to the detected diameter of the button in a front-and-rear direction, and to automatically sew a buttonhole with a predetermined length according to the diameter of the button.

The computer sewing machine disclosed in Reference 1 includes a buttonhole switch mechanism constituted by a buttonhole presser mounted on a lower end of a presser bar of the sewing machine, a buttonhole switching arm attached so as to be rotatable in a feed direction with a rotary shaft anchored to an upper left end of a machine frame of the sewing machine as a supporting point, a buttonhole switching lever attached so as to be movable vertically with respect to the buttonhole switching arm, and a detection switch fixed to an upper left end of the machine frame and having contacts electrically connected by the rotation of the buttonhole switching arm. When the buttonhole sewing is performed, first, a button is mounted on the buttonhole presser, and the interval of two projection portions formed on the buttonhole presser is adjusted to an interval according to the diameter of the button. Next, the buttonhole switching lever is pulled down to between the two projection portions. Then, if the buttonhole sewing is started, as the buttonhole switching lever abuts against each projection portion, the buttonhole switching arm is rotated, and the detection switch is electrically connected. Thereby, the cloth that becomes an object to be sewn moves automatically in the front-and-rear direction.

In addition, the invention disclosed in Reference 1 relates to a sewing machine that suppresses occurrence of stitch skipping in a stepped portion during double fabric sewing, and a structure in which a movable portion of a double fabric sewing presser mounted on a lower end of a presser bar is combined with the above buttonhole switching lever is described in Reference 1. According to this structure, the buttonhole switching lever is rotated and the detection switch is electrically connected in conjunction with the vertical movement of the movable portion of the double fabric sewing presser during double fabric sewing (step ascent, step descent). Then, by operating a needle and shuttle timing adjustment mechanism in conjunction with the electrical connection of the detection switch, it is possible to adjust the encounter timing between the sewing needle and the shuttle to prevent occurrence of stitch skipping of a seam.

In the computer sewing machine disclosed in Reference 2, a housing of a sewing machine main body is equipped with a BH sensor that detects the diameter of a button. The BH sensor is constituted by a detection lever, a button case, and a sliding volume (variable resistor). If the detection lever is moved and a button is inserted between the inner wall of the button case and the detection lever after the button is set in the button case, the resistance value of the sliding volume can change according to the travel distance of the detection lever, and the diameter of the button corresponding to the resistance value can be detected. Then, in CPU of the sewing machine, sewing data of the buttonhole is created on the basis of the detected diameter of the button and a cloth feed amount set by a user, and the buttonhole sewing is automatically performed on the basis of this sewing data.

The computer sewing machine disclosed in Reference 3 has a sliding volume built into a buttonhole presser mounted on a lower end of a presser bar of the sewing machine. The buttonhole presser is equipped with a presser body fixed to the presser bar, and a presser frame that slides in a front-and-rear direction with respect to the presser body, and the amount of relative displacement between the presser body and the presser frame can be detected by the sliding volume. In this sewing machine, the buttonhole sewing is automatically performed while performing detection of the diameter of a button mounted on the buttonhole presser depending on a change in the resistance value of the sliding volume and performing regular detection of the position of the buttonhole presser.

In the sewing machine disclosed in Reference 1, in order to ensure the quality (appearance) of the buttonhole sewing, it is necessary to electrically connect contacts of the detection switch precisely according to a predetermined amount of rotation of the buttonhole switching arm. For this reason, in a sewing machine manufacturing process, an adjustment mechanism and an adjustment process with which a manufacturer (worker) is able to adjust the electrical connection position of the detection switch are required. Although the adjustment of the electrical connection position of the detection switch is not described in Reference 1, the adjustment of the electrical connection position is performed as will be described below. Side views schematically illustrating the buttonhole switch mechanism of the sewing machine described in Reference 1 are shown in FIGS. 11A to 11C. In FIG. 11A, 7 represents a buttonhole presser, 120 represents a lever member in which a buttonhole switching arm and a buttonhole switching lever are integrally expressed, 23 represents a detection switch, and 124 represents a mount of the detection switch 23. A rotary shaft 120*c* of the lever member 120 and a rotary shaft 124*a* of the mount 124 are fixed to a non-movable part of a sewing machine main body, respectively. As shown in FIG. 11B, the detection switch 23 is a two-contact-type switch that has a central contact 23*a*, a rear contact 23*b*, and a front contact 23*c*.

Before the adjustment of the electrical connection position of the detection switch 23, as shown in FIG. 11B, the contact spacing between the central contact 23*a* and the rear contact 23*b* and the contact spacing between the central contact 23*a* and the front contact 23*c* are an equal spacing F3. In a case where a push-in amount F2 of a lower end portion 120*b* to the front is large when the lower end portion 120*b* of the lever member 120 is brought into contact with a projection portion 72*a* of the buttonhole presser 7 as shown in FIG. 11A in order to start the buttonhole sewing, the travel distance of the central contact 23*a* to the rear, which is moved by a switching operation portion 120*a* of an upper end of the lever member 120 also becomes large. At this time, in a case where the central contact 23*a* is brought into a state where the central contact is excessively pushed into the rear contact 23*b* side, the quality of the buttonhole sewing is impaired due to the shift of the electrical connection position of the detection switch 23. Thus, a manufacturer rotates the mount 124 around the rotary shaft 124*a* to adjust the contact spacing between the central contact 23*a* and the rear contact 23*b* of the detection switch 23 to F5 larger than F3 (shown in FIG. 11C). Thereby, it is possible to avoid the central contact 23*a* being excessively pushed into the rear contact 23*b* side at the time of the start of the buttonhole sewing.

There are problems to be described below in the adjustment mechanism for the electrical connection position of the above-described detection switch 23. First, in the above-described adjustment mechanism, adjustment is performed by manufacturer's trial and error. Therefore, in a case where the number of times of repetition of trial and error increases, there is a problem in that work man-hours may increase and manufacturing costs may rise. Secondly, in the above-described adjustment mechanism, adjustment is performed by a skilled manufacturer, and it is difficult for a user to perform adjustment. For this reason, in a case where a defect occurs again in the electrical connection position of the detection switch 23 after use of the sewing machine, there is an inconvenience that a user needs to make a request to a maker or the like to repair the sewing machine.

Thirdly, the contact spacing between the central contact 23*a* and the front contact 23*c* is reduced from F3 to F4 by increasing the contact spacing between the central contact 23*a* and the rear contact 23*b* from F3 to F5 (shown in FIG. 11C). At this time, in a case where the amount of adjustment of the electrical connection position of the detection switch 23 is large and the contact spacing F4 becomes excessively small, the shift gap of the timing at which the direction in which cloth is fed is reversed becomes marked. That is, in a case where the contact spacing F4 is small when the lower end portion 120*b* of the lever member 120 contacts a projection portion 71*a* of the buttonhole presser 7 and the direction in which the cloth is fed is reversed, the direction in which the cloth is fed is reversed at an early timing. Thereby, there is a problem in that the sewing length of a buttonhole becomes shorter than a setting value. Fourthly, in the above-described adjustment mechanism, the rotary shaft 120*c* of the lever member 120 is fixed to the non-movable part of the sewing machine main body. Therefore, in order to keep the push-in amount F2 of the lever member 120 within an adjustable range of the electrical connection position of the detection switch 23, there are problems in that excessively high dimensional precision of sewing machine component parts and excessively high assembling precision of a sewing machine manufacturing process are required and manufacturing costs rise.

Side views schematically illustrating a buttonhole switch mechanism different from the buttonhole switch mechanism of the sewing machine described in Reference 1 are shown in FIGS. 12A to 12C. Although the buttonhole switch mechanism shown in FIGS. 12A to 12C has the structure in which the detection switch 23 and the lever member for operating the detection switch 23 are combined similarly to Reference 1, the buttonhole switch mechanism includes an adjustment mechanism for the electrical connection position of the detection switch 23 that is different from Reference 1. As shown in FIG. 12A, a lever member 220 of the buttonhole switch mechanism is split into a lever body 221 and an adjusting portion 222, and is adapted to be able to change an angle H1 formed between the lever body 221 and the adjusting portion 222. The lever member 220 in which the lever body 221 and the adjusting portion 222 are integrated is rotatably supported by a rotary shaft 220*c* fixed to the non-movable part of the sewing machine main body.

As shown in FIG. 12B, before the adjustment of the electrical connection position of the detection switch 23, the angle H1 formed between the lever body 221 and the adjusting portion 222 is 180°. In the sewing machine manufacturing process, when a manufacturer brings a lower end portion 220*b* of the adjusting portion 222 into contact with the projection portion 72*a* of the buttonhole presser 7, a state, where a push-in amount H2 of the lower end portion 220*b* to the front is large and the contact of the detection switch 23 is excessively pushed in by a switching operation portion 220*a* of the upper end of the lever body 221, is brought about. At this time, as shown in FIG. 12C, the excessive push-in amount of the contact of the detection switch 23 can be reduced as a manufacturer changes the angle H1 formed between the lever body 221 and the adjusting portion 222 to an angle smaller than 180°.

There are problems to be described below in the adjustment mechanism for the electrical connection position of this detection switch 23. First, the inclination of the adjusting portion 222 becomes large as the amount of adjustment of the angle H1 increases. Thereby, the effective width (horizontal distance between a contact of the lower end portion 220*b* with the projection portion 71*a* and a contact of the lower end portion 220*b* with the projection portion 72*a*) of the lower end portion 220*b* of the adjusting portion 222 increases from an effective width H3 shown in FIG. 12B to an effective width H4 shown in FIG. 12C. Also, as the effective width of the lower end portion 220*b* increases, the direction in which the cloth is fed is reversed at an early timing. Thereby, there is a problem in that the sewing length of a buttonhole becomes shorter than a setting value. Secondly, the rotary shaft 220*c* of the lever member is fixed to the non-movable part of the sewing machine main body. Therefore, in order to keep the push-in amount H2 of the lower end portion 220*b* of the adjusting portion 222 within an adjustable range of the electrical connection position of the detection switch 23, there are problems in that excessively high dimensional precision of the sewing machine component parts and excessively high assembling precision of the sewing machine manufacturing process are required and manufacturing costs rise.

In the sewing machine disclosed in Reference 2, the sliding volume is used for the detection mechanism that detects the diameter of a button, and in the sewing machine disclosed in Reference 3, the sliding volume is used for the detection mechanism for the diameter of a button and the position of buttonhole presser. In the sewing machines disclosed in References 2 and 3, the adjustment mechanism for the electrical connection position of the detection switch 23 in the above-described Reference 1 becomes unnecessary due to using the sliding volume. Accordingly, in the sewing machines disclosed in References 2 and 3, the above-described problems, that is, the problem that the sewing length of the buttonhole becomes shorter than a setting value, the problem that excessively high dimensional precision of the sewing machine component parts is required, and the problem that excessively high assembling precision of the sewing machine manufacturing process is required are solved.

Incidentally, since the sliding volume is used in the sewing machines disclosed in References 2 and 3, there are problems to be described below. First, since the sliding volume is expensive as compared to the buttonhole switch mechanism described in Reference 1 in which the detection switch and the lever member for operating the detection switch are combined, there is a problem in that product costs rise. Secondly, in the sliding volume, variation or hysteresis of resistance value occurs even within the same manufacturing lot. Therefore, the sewing machine manufacturing process requires an adjustment mechanism and an adjustment process such that a manufacturer electrically changes the resistance value of the sliding volume or changes the setting value of a calibration factor by which the resistance value of the sliding volume is multiplied using software. In this adjustment process, adjustment is performed by the manufacturer's trial and error. Therefore, in a case where the number of times of repetition of the trial and error increases, there is a problem in that work man-hours may increases and manufacturing costs may rise.

Moreover, in the sewing machine disclosed in Reference 3, the sliding volume is built into the buttonhole presser. Therefore, it is necessary to connect a harness extending from the buttonhole presser to a connecting portion of the sewing machine main body. Accordingly, there is inconvenience that a user should pay attention so that the cloth is not entangled in the harness when the cloth that becomes as an object to be sewn is set in the sewing machine or during sewing.

This disclosure has been made in view of the above-described circumstances, and a need thus exists for a buttonhole switch mechanism of a buttonhole sewing machine in which product costs are inexpensive by using a buttonhole switch mechanism in which a detection switch and a lever member for operating the detection switch are combined and in which excessively high dimensional precision of sewing machine component parts and excessively high assembling precision of a sewing machine manufacturing process are not required by including an adjustment mechanism that can easily adjust the electrical connection position of the detection switch.

SUMMARY

In order to solve the above problems, according to a first aspect of the embodiment disclosed here, there is provided a buttonhole switch mechanism of a buttonhole sewing machine including: a buttonhole presser mounted on a lower end of a presser bar of the sewing machine and having a presser frame that is movable in a front-and-rear direction with respect to the presser bar, and two projection portions that are provided side by side in the front-and-rear direction at an interval according to the diameter of a button and move integrally with the presser frame; a buttonhole switch mechanism disposed on an arm section of the sewing machine and having a detection switch of which contacts are electrically connected when the presser frame is located on the foremost side and when the presser frame is located on the rearmost side; a feed dog disposed below the buttonhole presser to move cloth, which is an object to be sewn, in the front-and-rear direction at a predetermined feed pitch in cooperation with the presser frame; a sewing needle forming stitches in the cloth with vertical movement and adapted to be movable in a right-and-left direction; a controller performing control on the movement of the feed dog and the sewing needle on the basis of the electrical connection of the detection switch of the buttonhole switch mechanism; a fixing member fixed to a non-movable part of a sewing machine main body; a mount supported so as to be movable in the front-and-rear direction with respect to the fixing member; an adjustment mechanism adjusting and fixing the relative positions of the fixing member and the mount in the front-and-rear direction; a lever member supported by a rotary shaft provided at the mount so as to be rotatable in the front-and-rear direction and being capable of extending a lower end portion between both the projection portions of the buttonhole presser; and the detection switch fixed to the mount and electrically connected as the lower end portion of the lever member is pushed and rotated by each projection portion.

BRIEF DESCRIPTION OF THE DRAWINGS

The foregoing and additional features and characteristics of this disclosure will become more apparent from the following detailed description considered with the reference to the accompanying drawings, wherein:

FIG. 2A shows a stored state of a buttonhole switching lever, and FIG. 2B shows a lowered state of the buttonhole switching lever;

FIG. 7A shows a state where the buttonhole presser is at a start position of buttonhole sewing, FIG. 7B shows a state where the buttonhole presser is at a reversal position of the buttonhole sewing, and FIG. 7C shows a state where the buttonhole presser is at an end position of the buttonhole sewing;

FIG. 8A shows a state where the detection switch is not electrically connected, FIG. 8B shows a state where a central contact and a rear contact of the detection switch are electrically connected, and FIG. 8C shows a state where the central contact and a front contact of the detection switch are electrically connected;

FIG. 11A shows a state before adjustment of the electrical connection position of the detection switch is performed, FIG. 11B shows an enlarged situation of the surroundings of the detection switch shown in FIG. 11A, and FIG. 11C shows an enlarged situation of the surroundings of the detection switch after adjustment of the electrical connection position of the detection switch is performed; FIG. 12A shows a state before adjustment of the electrical connection position of the detection switch is performed, FIG. 12B shows an enlarged situation of an adjusting portion of a lever member in FIG. 12A, and FIG. 12C shows an enlarged situation of the adjusting portion of the lever member after adjustment of the electrical connection position of the detection switch is performed.

DETAILED DESCRIPTION

Figure 1:
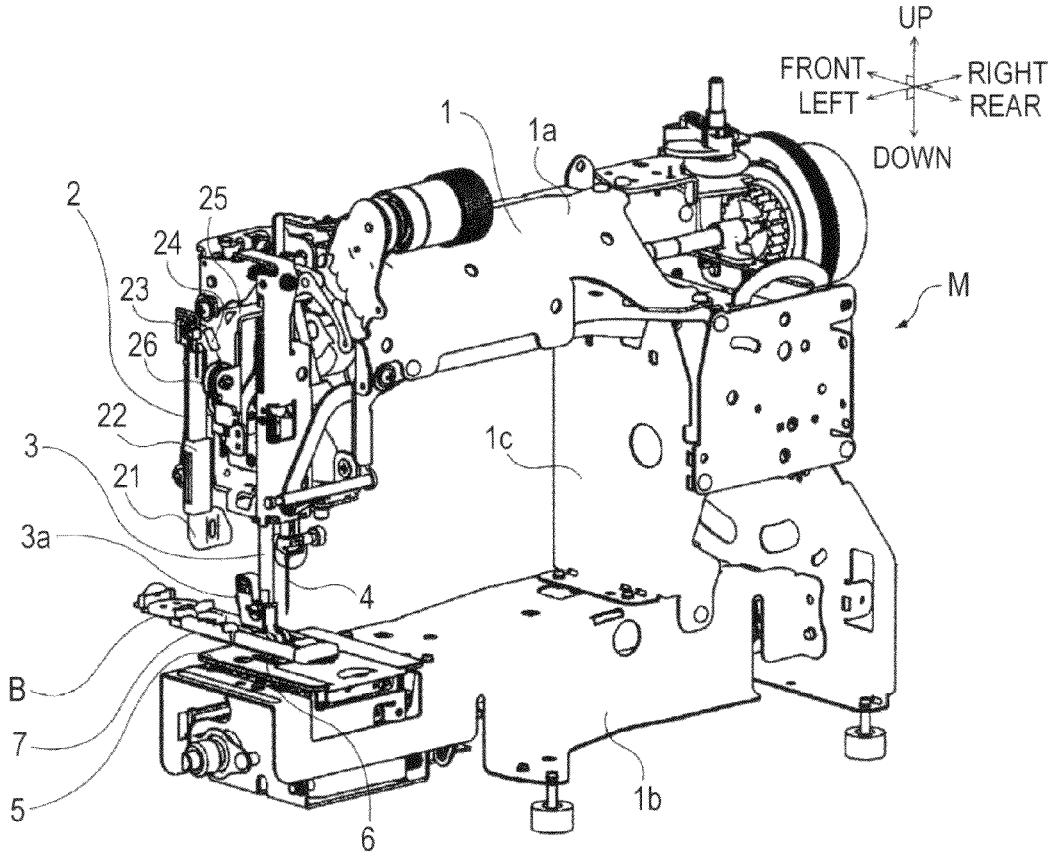
FIG. 1 is a perspective view illustrating a state where a housing of a sewing machine equipped with a buttonhole switch mechanism of one embodiment disclosed here is removed.

In order to solve the above problems, the constitutional feature of a buttonhole switch mechanism related to a first aspect is a buttonhole switch mechanism of a buttonhole sewing machine including a buttonhole presser mounted on a lower end of the presser bar of a sewing machine and having a presser frame that is movable in a front-and-rear direction with respect to the presser bar, and two projection portions that are provided side by side in the front-and-rear direction at an interval according to the diameter of a button and move integrally with the presser frame; a buttonhole switch mechanism disposed on an arm section of the sewing machine and having a detection switch of which contacts are electrically connected when the presser frame is located on the foremost side and when the presser frame is located on the rearmost side; a feed dog disposed below the buttonhole presser to move cloth, which is an object to be sewn, in the front-and-rear direction at a predetermined feed pitch in cooperation with the presser frame; a sewing needle forming stitches in the cloth with vertical movement and adapted to be movable in a right-and-left direction; a controller performing control on the movement of the feed dog and the sewing needle on the basis of the electrical connection of the detection switch of the buttonhole switch mechanism; a fixing member fixed to a non-movable part of a sewing machine main body; a mount supported so as to be movable in the front-and-rear direction with respect to the fixing member; an adjustment mechanism adjusting and fixing the relative positions of the fixing member and the mount in the front-and-rear direction; a lever member supported by a rotary shaft provided at the mount so as to be rotatable in the front-and-rear direction and being capable of extending a lower end portion between both the projection portions of the buttonhole presser; and the detection switch fixed to the mount and electrically connected as the lower end portion of the lever member is pressed and rotated by each of the projection portions.

Since the buttonhole switch mechanism related to the first aspect is a mechanism in which the detection switch and the lever member for operating the detection switch are combined, the buttonhole switch mechanism is inexpensive as compared to the mechanisms using the sliding volume in the sewing machines disclosed in References 2 and 3.

Additionally, according to the buttonhole switch mechanism related to the first aspect, the adjustment mechanism is operated, so that the mount, in which the lever member and the detection switch are integrally provided, can be relatively moved in the front-and-rear direction with respect to the fixing member fixed to the non-movable part of the sewing machine main body, and be fixed. That is, the adjustment mechanism is operated, so that the relative positions in the front-and-rear direction between the lever member and the detection switch, and the buttonhole presser can be adjusted and fixed to perform adjustment of the electrical connection position of the detection switch. In addition, the adjustment mechanism may be a mechanism that simultaneously performs the adjustment and fixation of the relative positions of the fixing member and the mount in the front-and-rear direction, and may be a mechanism that separately performs the adjustment and the fixation.

In this way, the adjustment mechanism that moves the mount in which the lever member and the detection switch are integrally provided in the front-and-rear direction, thereby adjusting the electrical connection position of the detection switch, have the following advantages as compared with the adjustment mechanism that rotates the detection switch or the lever member as shown in FIGS. 11A to 11C or FIGS. 12A to 12C, thereby adjusting the electrical connection position of the detection switch. First, even in a case where the amount of adjustment using the adjustment mechanism is large, the quality of buttonhole sewing is excellent because the timing at which a cloth feed direction is reversed is not shifted and the sewing length of a buttonhole is not influenced. Secondly, the adjustment range can be widely set compared to the related art shown in FIGS. 11A to 11C or FIGS. 12A to 12C because the positional relationship between the lever member and the detection switch does not change before and after adjustment. Hence, an increase in manufacturing cost can be suppressed, without requiring excessively high dimensional precision of the sewing machine component parts and excessively high assembling precision of the sewing machine manufacturing process.

Thirdly, when the electrical connection position of the detection switch is adjusted, the mount may be moved in the front-and-rear direction by the adjustment mechanism by an amount equal to the amount of adjustment for adjusting the push-in amount of the lower end portion of the lever member to a normal push-in amount. Accordingly, according to this disclosure, the adjustment of the electrical connection position of the detection switch is simple and easy, and the number of times of repetition of adjustment by the manufacturer's trial and error can be minimized to suppress an increase in manufacturing cost. Additionally, since the adjustment of the electrical connection position of the detection switch is simple and easy and adjustment by a skilled manufacturer becomes unnecessary, manufacturing costs can be reduced. Additionally, since the adjustment of the electrical connection position of the detection switch by a user is also easy in a case where defects occur again in the electrical connection position of the detection switch after use of the sewing machine, an aspect in which a user performs adjustment by himself/herself can also be adopted. The time and effort that are required to make a request to a maker or the like for repair of the sewing machine can be saved by doing so.

The constitutional feature of this disclosure related to a second aspect is the buttonhole switch mechanism described in the first aspect in which the adjustment mechanism adjusts the relative positions of the fixing member and the mount in the front-and-rear direction by a screw hole provided to pass through in the front-and-rear direction and an adjusting screw screwed into the screw hole.

According to the buttonhole switch mechanism related to the second aspect, the adjustment mechanism adjusts the relative positions of the fixing member and the mount in the front-and-rear direction by a screw hole provided to pass through in the front-and-rear direction and an adjusting screw screwed into the screw hole. For example, a configuration may be adopted in which the mount is formed with a screw hole and an adjusting screw rotatably held on the fixing member is screwed into this screw hole. Additionally, a configuration may also be adopted in which the fixing member is formed with a screw hole and an adjusting screw rotatably held on the mount is screwed into this screw hole. Additionally, the mount is formed with a screw hole of a normal screw and the fixing member is formed with a screw hole of a reverse screw, and both screw holes can be coupled by an adjusting screw that has a thread of the normal screw formed at one end and a thread of the reverse screw formed at the other end. Additionally, an adjusting screw of a normal screw is fixed to the mount and an adjusting screw of a reverse screw is fixed to the fixing member, and both the adjusting screws can be coupled by an adjusting nut that has a screw hole of the normal screw formed at one end and a screw hole of the reverse screw formed at the other end. Hence, according to this disclosure, the relative positions of the fixing member and the mount in the front-and-rear direction can be adjusted with a simple configuration.

The constitutional feature of this disclosure related to a third aspect is the buttonhole switch mechanism described in the second aspect in which the adjusting screw is provided with an operating portion having a larger diameter than the screw diameter of the adjusting screw.

According to the buttonhole switch mechanism related to the third aspect, the operating portion provided at the adjusting screw has a larger diameter than the screw diameter of the adjusting screw. Therefore, a manufacturer or a user can operate the operating portion with a small operation force to rotate the adjusting screw. Hence according to this disclosure, the operativity of the adjustment mechanism is excellent, and fine adjustment of the electrical connection position of the detection switch is easy.

The constitutional feature of this disclosure related to a fourth aspect is the buttonhole switch mechanism described in any one of the first to third aspects in which scales in the front-and-rear direction are provided on any one of the fixing member and the mount, and an indicator combined with the scales is provided on the other one of the fixing member and the mount.

According to the buttonhole switch mechanism related to the fourth aspect, a manufacturer or a user can recognize the amount of adjustment when the relative positions of the fixing member and the mount in the front-and-rear direction are changed as numerical values on the scales and the indicator. Thereby, after defects in the sewing finish quality of a buttonhole are measured, the manufacturer or the user can adjust the relative positions of the fixing member and the mount in the front-and-rear direction by the number of scales corresponding to the measurement value, thereby completing the adjustment of the electrical connection position of the detection switch. Hence, the number of times of repetition of the adjustment by manufacturer's trial and error can be minimized to once so as to suppress an increase in manufacturing cost to a maximum extent. Additionally, a user can rapidly and easily perform the adjustment of the electrical connection position of the detection switch in a case where defects occur again in the electrical connection position of the detection switch after use of the sewing machine.

As described, according to this disclosure, it is possible to provide a buttonhole switch mechanism of a buttonhole sewing machine in which product costs are inexpensive by using a buttonhole switch mechanism in which a detection switch and a lever member for operating the detection switch are combined and in which excessively high dimensional precision of sewing machine component parts and excessively high assembling precision of a sewing machine manufacturing process are not required by including an adjustment mechanism that can easily adjust the electrical connection position of the detection switch.

A buttonhole switch mechanism according to one embodiment disclosed here will be described with reference to FIGS. 1 to 10. In addition, up, down, left, right, front, and rear in the description are up, down, left, right, front, and rear shown in FIG. 1, and indicate up, down, left, right, front, and rear for a user when the user uses a sewing machine.

A sewing machine main body includes a housing (not shown) that becomes an outer shell, and a sewing machine body M that is a main element covered with the housing. As shown in FIG. 1, the sewing machine body M is constituted by a machine frame 1 (non-movable part) and various kinds of sewing machine component parts attached to the machine frame 1. The machine frame 1 has an upper arm section 1*a*, a lower bed section 1*b*, and a post part 1*c* that couples respective right ends of the arm section 1*a* and the bed section 1*b* in a vertical direction. A buttonhole switch mechanism 2, a presser bar 3 that is vertically movable according to the thickness of cloth that becomes an object to be sewn, and a sewing needle 4, that forms stitches in the cloth with the vertical movement and is adapted to be movable also in the right-and-left direction, are disposed at a left end of the arm section 1*a* of the machine frame 1. Additionally, a needle plate 5, and a feed dog 6 for cloth feed capable of being retractable with respect to the top surface of the needle plate 5 is disposed on the left side of the bed section 1*b* of the machine frame 1. The presser holder 3*a* screwed to a lower end of the presser bar 3 is mounted with a buttonhole presser 7.

Figure 2A:
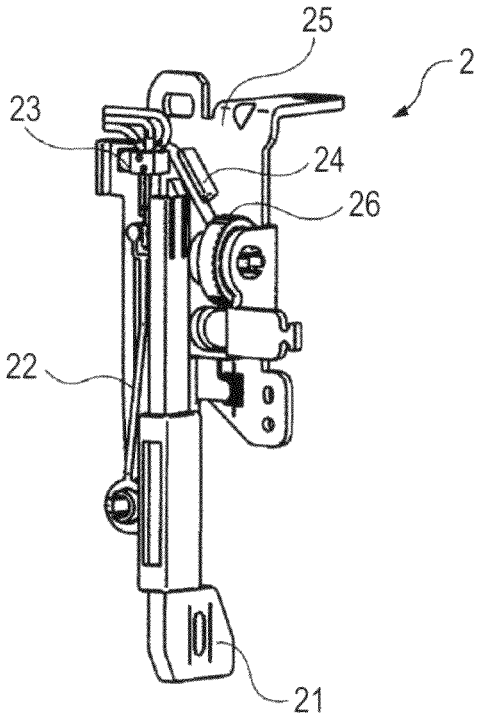
FIGS. 2A and 2B are perspective views of the buttonhole switch mechanism of one embodiment disclosed here.
Figure 2B:
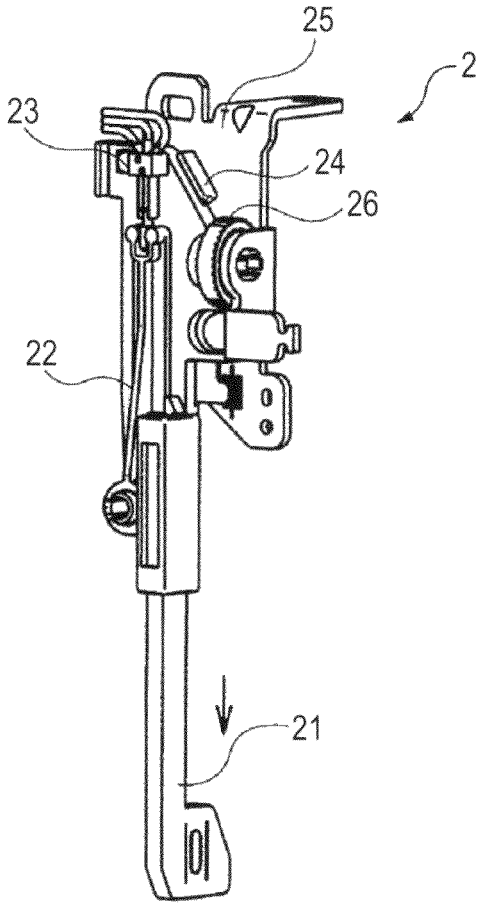
Figure 3:
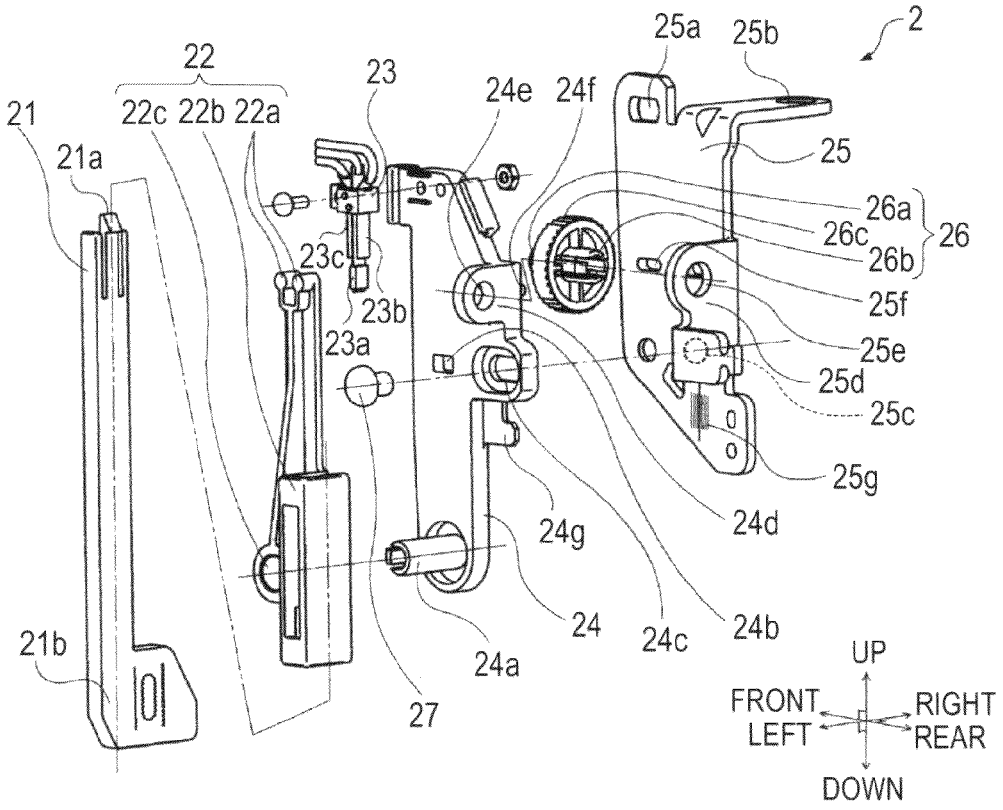
FIG. 3 is an exploded perspective view of the buttonhole switch mechanism of one embodiment disclosed here.

As shown in FIGS. 2A, 2B and 3, the buttonhole switch mechanism 2 is equipped with a buttonhole switching lever 21 (lever member), a buttonhole switching arm 22 (lever member), a detection switch 23, a mount 24, a base plate 25 (fixing member), and an adjustment mechanism 26. As shown in FIGS. 2A and 2B, the buttonhole switch mechanism 2 is attached to the machine frame 1 by screwing and fixing the base plate 25 to a left end of the arm section 1*a* of the machine frame 1 after all these parts are integrated.

The buttonhole switching lever 21 is a rod-shaped member that has a locking claw 21*a* formed on an upper end and a knob portion 21*b* (lower end portion) formed on a lower end, has a rectangular cross-section, and is elongated in the vertical direction. By inserting the buttonhole switching lever 21 upward from below a lever holding portion 22*b* of the buttonhole switching arm 22 to be described below, the buttonhole switching lever 21 is held so as to be slidable in the vertical direction with respect to the buttonhole switching arm 22. The buttonhole switching lever 21 and the buttonhole switching arm 22 that are integrated in this way are equivalent to a lever member disclosed here.

The buttonhole switching arm 22 is a rod-shaped member that has a switching operation portion 22*a* formed at an upper end, the lever holding portion 22*b* formed at a lower portion, and a bearing hole 22*c* located ahead of the lever holding portion 22*b* and passing through in the right-and-left direction and that is elongated in the vertical direction. The switching operation portion 22*a* assumes a U-shape in which a recess that is turned downward as seen from the right-and-left direction is formed. The lever holding portion 22*b* assumes a tubular shape that is elongated in the vertical direction of the rectangular cross-section. A rotary shaft 24*a* formed on the mount 24 to be described below is inserted into the bearing hole 22*c*, and dropping-out of the buttonhole switching arm 22 from the rotary shaft 24*a* is prevented by locking a locking claw formed on the tip of the rotary shaft 24*a* to a left end of the bearing hole 22*c*. Thereby, the buttonhole switching lever 21 and the buttonhole switching arm 22 that are integrated as the lever member are supported by the rotary shaft 24*a* formed on the mount 24 so as to be rotatable in the front-and-rear direction.

As a user grips the knob portion 21*b* of the buttonhole switching lever 21 and pulls out the buttonhole switching lever 21 downward, switching from the stored state of the buttonhole switching lever 21 shown in FIG. 2A to the lowered state of the buttonhole switching lever 21 shown in FIG.

2B is made. As will be described below, by bringing the knob portion 21*b* of the buttonhole switching lever 21 into contact with the buttonhole presser 7 and electrically connecting the detection switch 23, the controller 8 (shown in FIG. 9) determines that the buttonhole switching lever 21 has been lowered, and a state where buttonhole sewing is possible is brought about (shown in FIG. 5). As the locking claw 21*a* is locked to an upper end of the lever holding portion 22*b* in the lowered state of the buttonhole switching lever 21 shown in FIG. 2B, dropping-out of the buttonhole switching lever 21 from the lever holding portion 22*b* is prevented.

Figure 5:
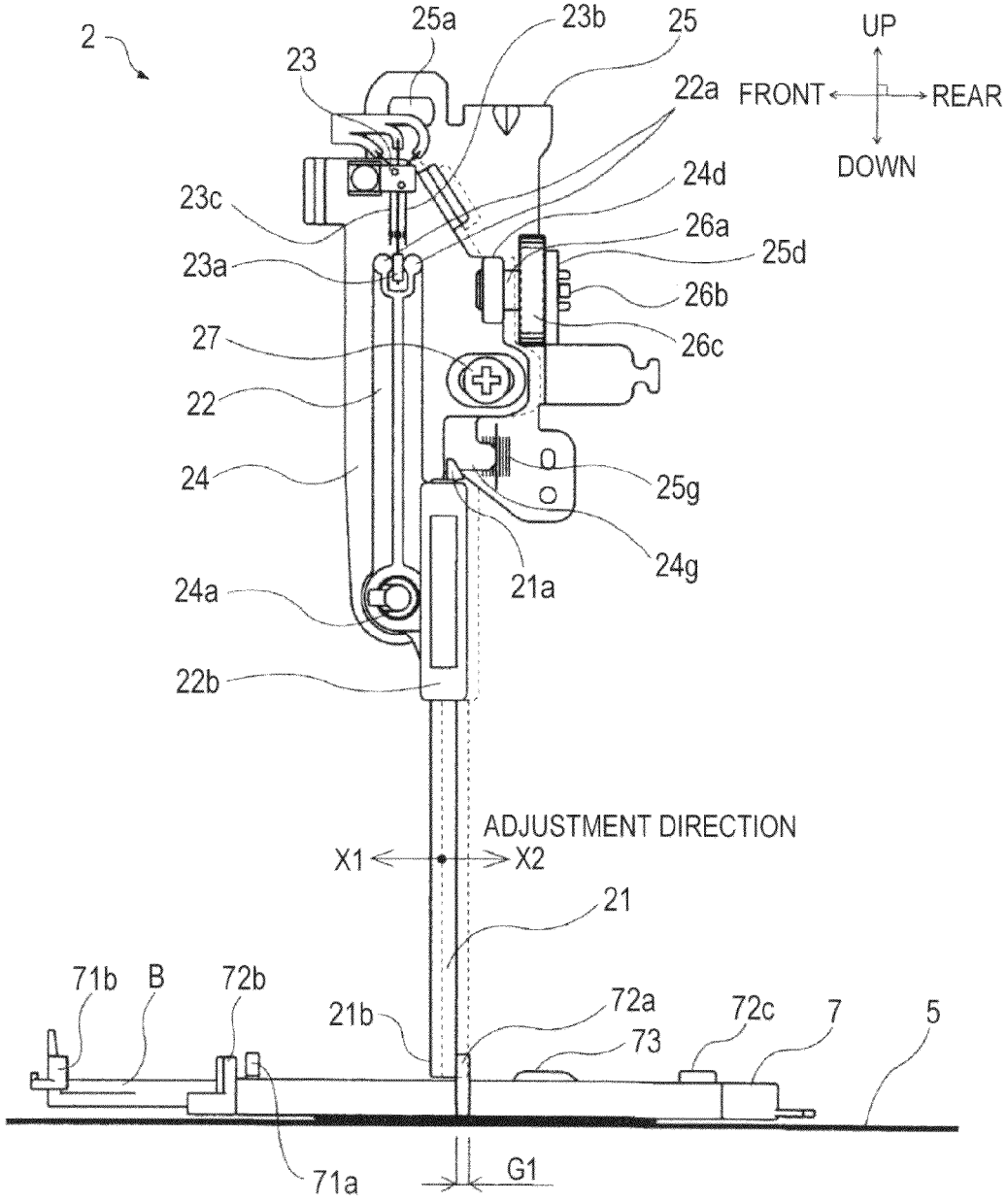
FIG. 5 is a side view illustrating an adjustment method of the electrical connection position of a detection switch equipped in the buttonhole switch mechanism of one embodiment disclosed here.

The detection switch 23 is a two-contact-type switch that has a central contact 23*a*, a rear contact 23*b*, and a front contact 23*c*. The detection switch 23 is arranged above the buttonhole switching arm 22, and is screwed and fixed to an upper portion of the mount 24. The respective contacts 23*a*, 23*b*, and 23*c* are made of thin metal plates that extend downward from upper ends with the same height. The contact spacing between the central contact 23*a* and the rear contact 23*b* and the contact spacing between the central contact 23*a* and the front contact 23*c* are equally spaced. As shown in FIG. 5, a lower end of the central contact 23*a* extends further downward than lower ends of the rear contact 23*b* and the front contact 23*c* with the same height, and is pinched by the recess of the switching operation portion 22*a* of the buttonhole switching arm 22.

If the knob portion 21*b* of the lower end of the buttonhole switching lever 21 rotates forward, the switching operation portion 22*a* of the upper end of the buttonhole switching arm 22 rotates rearward, and the central contact 23*a* and the rear contact 23*b* are electrically connected (brought into contact with each other). Additionally, if the knob portion 21*b* of the buttonhole switching lever 21 rotates rearward, the switching operation portion 22*a* of the buttonhole switching arm 22 rotates forward, and the central contact 23*a* and the front contact 23*c* are electrically connected. The electrical connection situation of the respective contacts 23*a*, 23*b*, and 23*c* of the detection switch 23 is sent to a controller 8 as an input signal via a harness connected to the respective contacts 23*a*, 23*b*, and 23*c* (shown in FIG. 9).

The mount 24 is a plate-shaped member that has a surface that spreads in the up-and-down direction and the front-and-rear direction and is elongated in the vertical direction. A lower portion of the surface of the mount 24 is formed with the above-mentioned rotary shaft 24*a* that protrudes toward the left. An elongated-hole-shaped stopper hole 24*b* that is elongated in the front-and-rear direction and passes through in the right-and-left direction is formed in the vicinity of the center of the surface of the mount 24. The rotation range of the buttonhole switching arm 22 is regulated by inserting a pin (not shown) provided at the rear surface (right surface) of the buttonhole switching arm 22 into the stopper hole 24*b*.

An elongated-hole-shaped set screw hole 24*c* that is elongated in the front-and-rear direction and passes through in the right-and-left direction is formed in the center and rear portion of the surface of the mount 24 in the up-and-down direction. A flange portion 24*d* that protrudes toward the left is formed at a rear end of the mount 24 slightly above the set screw hole 24*c*, and the flange portion 24*d* is formed with a screw hole 24*e* that passes through in the front-and-rear direction. The rear surface (right surface) of the mount 24 is provided with a pin 24*f* that protrudes toward the right. A rear end of the mount 24 slightly below the set screw hole 24*c* is formed with a plate-shaped indicator 24*g* that protrudes rearward and has a perpendicular end portion.

The base plate 25 is a plate-shaped member that has a surface that spreads in the up-and-down direction and the front-and-rear direction and is elongated in the vertical direction. An elongated-hole-shaped set screw hole 25*a* that is elongated in the front-and-rear direction and passes through in the right-and-left direction is formed in a front half portion above the surface of the base plate 25. Additionally, a rear half portion above the surface of the base plate 25 is bent toward the right, and an elongated-hole-shaped set screw hole 25*b* that is elongated in the right-and-left direction and passes through in the vertical direction is formed in this bent surface. The front, rear, right, and left positions of the base plate 25 are finely adjusted using these elongated-hole-shaped set screw holes 25*a* and 25*b*, and the base plate 25 is screwed and fixed to the machine frame 1 (shown in FIGS. 1 and 7A to 7C).

A screw hole 25*c* that passes through in the right-and-left direction is formed in a position corresponding to the set screw hole 24*c* of the above-described mount 24, in a lower and rear portion of the surface of the base plate 25. A flange portion 25*d* that protrudes toward the left is formed at a rear end of the center of the base plate 25 in the vertical direction, and a bearing hole 25*e* that passes through in the front-and-rear direction is formed in a position corresponding to the screw hole 24*e* of the above-described mount 24 in the flange portion 25*d*. An elongated-hole-shaped regulating hole 25*f* that is elongated in the front-and-rear direction and passes through in the right-and-left direction is formed in the vicinity of the center of the surface of the base plate 25. When the mount 24 is attached to the base plate 25, the pin 24*f* provided at the mount 24 is inserted into the regulating hole 25*f*. Thereby, the movable direction of the mount 24 is regulated in the front-and-rear direction.

Figure 6:
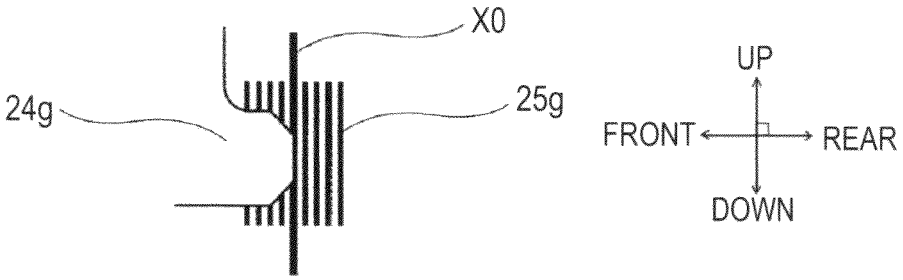
FIG. 6 is a side view of scales and an indicator equipped in the buttonhole switch mechanism of one embodiment disclosed here.

Scales 25*g* in the front-and-rear direction are drawn at a position corresponding to the indicator 24*g* of the above-described mount 24, below the surface of the base plate 25. As shown in FIG. 6, for example, the scales 25*g* are drawn in the front-and-rear direction by perpendicular lines with an interval of 0.5 mm, and the position and travel distance of the mount 24 in the front-and-rear direction with respect to the base plate 25 can be recognized as numerical values by reading the overlapping position of the scales 25*g* and a perpendicular end portion of the indicator 24*g*. In addition, a central line X0 of the scales 25*g* in the front-and-rear direction is a line longer than the other lines, and the end portion of the indicator 24*g* overlaps the central line X0 of the scales 25*g* when the mount 24 is located at the center of the movable range in the front-and-rear direction.

An adjustment dial 26 is an article integrally molded from a synthetic resin material, and is equipped with a screw portion 26*a* (adjusting screw), a rotary shaft 26*b*, and an operating portion 26*c* that are coaxially provided in the front-and-rear direction. The screw portion 26*a* is formed on the front side of the adjustment dial 26, the rotary shaft 26*b* is formed on the rear side, and the operating portion 26*c* is formed at an intermediate portion in the front-and-rear direction, and the diameter of the operating portion 26*c* is made larger than the screw diameter of the screw portion 26*a*. The operating portion 26*c* includes four spokes that extend radially outward from the outer peripheral surface of the rotary shaft 26*b*, and a rim supported by the four spokes, and tooth-form working for antislip for ensuring operability with a finger is performed on the outer peripheral surface of the rim. The screw portion 26*a* of the adjustment dial 26 is screwed into the screw hole 24*e* of the mount 24 from the rear. The rotary shaft 26*b* of the adjustment dial 26 is inserted into the bearing hole 25*e* of the base plate 25 from the front, and is rotatably held by the bearing hole 25*e*. The tip (rear end) of the rotary shaft 26*b* is formed with a locking claw for preventing the rotary shaft 26*b* from being pulled out from the bearing hole 25*e*.

The relative position of the mount 24 in the front-and-rear direction with respect to the base plate 25 can be adjusted by operating to rotate the operating portion 26*c* of the adjustment dial 26. The mount 24 is screwed and fixed onto the base plate 25 by fastening a fixing screw 27 inserted from the left of the set screw hole 24*c* of the mount 24 and screwed into the screw hole 25*c* of the base plate 25. Since the adjustment mechanism disclosed here is a mechanism that adjusts and fixes the relative position in the front-and-rear direction between the mount 24 and the base plate 25, the adjustment mechanism in the present embodiment is constituted by the above-described set screw hole 24*c*, screw hole 24*e*, screw hole 25*c*, bearing hole 25*e*, adjustment dial 26, and fixing screw 27.

Figure 4:
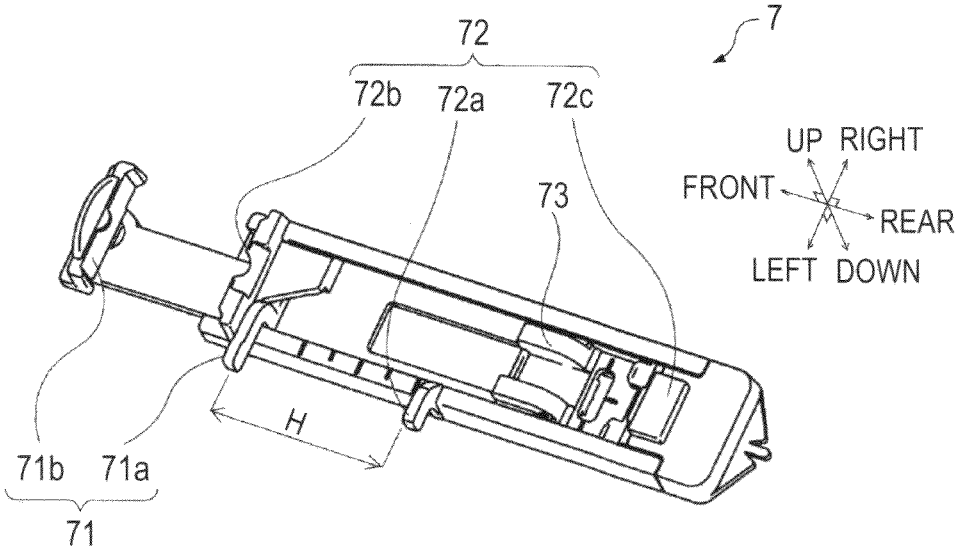
FIG. 4 is a perspective view of a buttonhole presser combined with the buttonhole switch mechanism of one embodiment disclosed here.

As shown in FIG. 4, the buttonhole presser 7 to be used in the present embodiment is the same as the buttonhole presser 7 used in the sewing machine disclosed in Reference 1. The buttonhole presser 7 is equipped with a presser frame 72 that is a main body, a button diameter measurement member 71 attached to the presser frame 72 in the state of being slidable in the front-and-rear direction, and a sliding member 73 attached in the state of being slidable on the presser frame 72. As the presser holder 3*a* of the lower end of the presser bar 3 is mounted with the sliding member 73, the presser frame 72 is movable in the front-and-rear direction with respect to the presser bar 3.

The presser frame 72 assumes a rectangular frame-shaped planar shape that is elongated in the front-and-rear direction. An intermediate portion of the left of the presser frame 72 in the front-and-rear direction is formed with a lever operating arm 72*a* (projection portion) that protrudes upward and leftward. A front end of the presser frame 72 is formed with a button contact surface 72*b* that protrudes upward. A rear portion within the presser frame 72 is formed with a stopper 72*c* that abuts against the sliding member 73. The sliding member 73 is biased by the biasing force (spring force) of a biasing member (not shown) so as to abut against the stopper 72*c*.

The button diameter measurement member 71 assumes a rectangular plate-shaped planar shape that is elongated in the front-and-rear direction. The left and right long sides of the button diameter measurement member 71 are slidably pinched by a frame of the left and right long sides of the presser frame 72. A rear end of the left of the button diameter measurement member 71 is formed with a lever operating arm 71*a* (projection portion) that protrudes upward and leftward. A front end of the button diameter measurement member 71 is formed with a button contact surface 71*b* that protrudes upward. When the button diameter measurement member 71 is sliding to the rearmost side with respect to the presser frame 72, the lever operating arm 71*a* and the lever operating arm 72*a* abut against each other, and the button contact surface 71*b* and the button contact surface 72*b* abut against each other (not shown). As shown in FIGS. 1 and 5, a button B is inserted between the button contact surface 71*b* of the button diameter measurement member 71 and the button contact surfaces 72*b* of the presser frame 72, an interval H between the lever operating arm 71*a* of the button diameter measurement member 71 and the lever operating arm 72*a* of the presser frame 72 changes according to the diameter of the button B. The length dimension during buttonhole finish sewing is determined depending on the interval H.

Figures 7A, 7B, 7C:
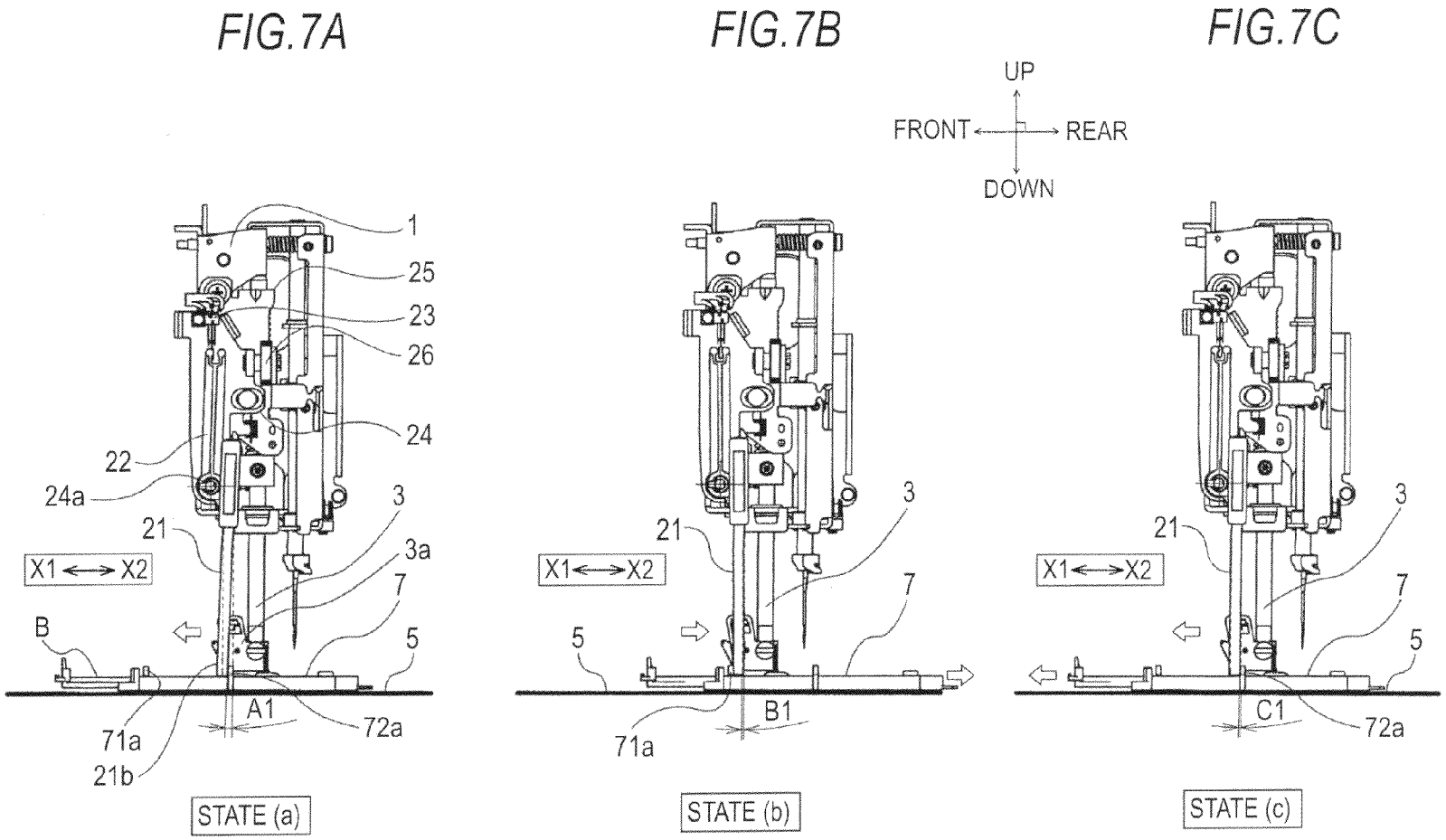
FIGS. 7A to 7C are state transition diagrams describing the operation of the buttonhole switch mechanism of one embodiment disclosed here.
Figure 8A:
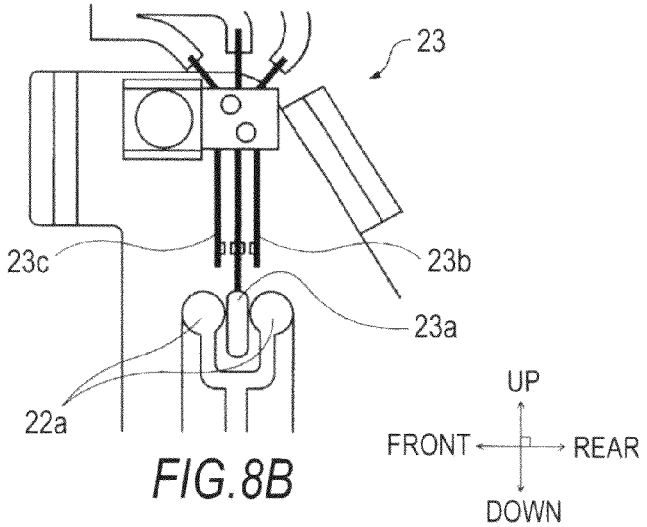
FIGS. 8A to 8C are side views illustrating the operation of the detection switch equipped in the buttonhole switch mechanism of one embodiment disclosed here.
Figure 8B:
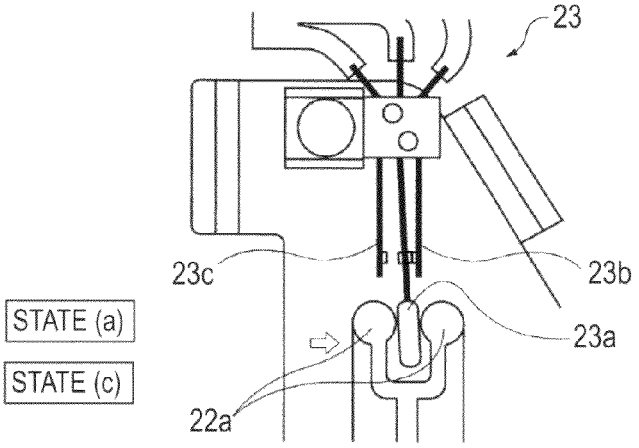
Figure 8C:
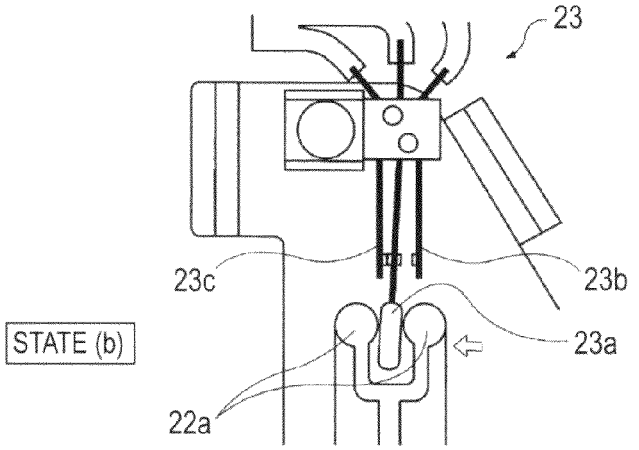

The buttonhole sewing in a computer sewing machine equipped with the above-described buttonhole switch mechanism 2 and buttonhole presser 7 will be described with reference to FIGS. 5 to 10. FIGS. 7A to 7C show state transition diagrams illustrating the operation of the buttonhole switch mechanism 2 and the buttonhole presser 7 when the buttonhole sewing is performed. FIG. 7A shows a state (a) where the buttonhole presser 7 is at a start position of the buttonhole sewing, FIG. 7B shows a state (b) where the buttonhole presser 7 is at a reversal position of the buttonhole sewing, and FIG. 7C shows a state (c) where the buttonhole presser 7 is at an end position of the buttonhole sewing. FIGS. 8A to 8C show side views illustrating the operation of the detection switch 23. FIG. 8A shows a state where the detection switch 23 is not electrically connected, FIG. 8B shows a state where the central contact 23*a* and the rear contact 23*b* of the detection switch 23 are electrically connected, and FIG. 8C shows a state where the central contact 23*a* and the front contact 23*c* of the detection switch 23 are electrically connected.

In a normal sewing state, as shown in FIGS. 1 and 2A, the buttonhole switching lever 21 is brought into the stored state. At this time, as shown in FIG. 8A, the respective contacts 23*a*, 23*b*, and 23*c* of the detection switch 23 are spaced apart, and neither of the two contacts of the detection switch 23 are electrically connected. As shown in FIG. 4, a user causes the sliding member 73 of the buttonhole presser 7 to abut against the stopper 72*c*, as a preparatory operation of performing the buttonhole sewing, bringing into a state where the presser frame 72 is moving to the foremost side.

As shown in FIG. 5, if the knob portion 21*b* of the lower end of the buttonhole switching lever 21 is pulled down until the knob portion contacts the lever operating arm 72*a* of the buttonhole presser 7, as shown in FIG. 7A, the buttonhole switching arm 22 rotates the rotary shaft 24*a* in the clockwise direction at a supporting point, and the central contact 23*a* and the rear contact 23*b* of the detection switch 23 are electrically connected by the switching operation portion 22*a* of the buttonhole switching arm 22 (shown in FIG. 8B). This is an input signal of a first buttonhole sensor shown in FIG. 9. In a case where the buttonhole sewing is selected by a user, starting of the sewing machine is controlled by a start/stop switch 10 only when there is this input signal, thereby preventing the sewing machine from starting while the user has forgotten to pull-down the buttonhole switching lever 21.

Figure 9:
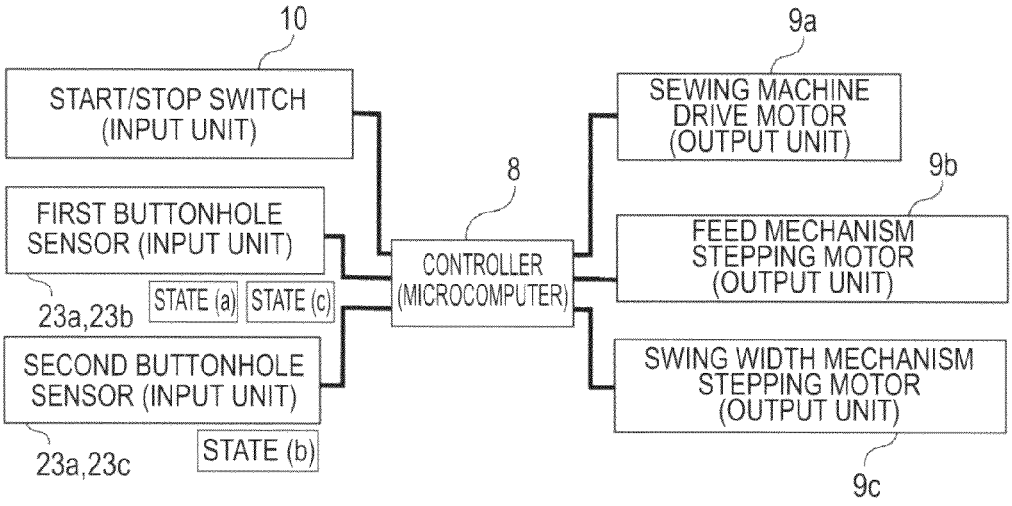
FIG. 9 is a block diagram of a controller of the sewing machine equipped with the buttonhole switch mechanism of one embodiment disclosed here.
Figure 10:
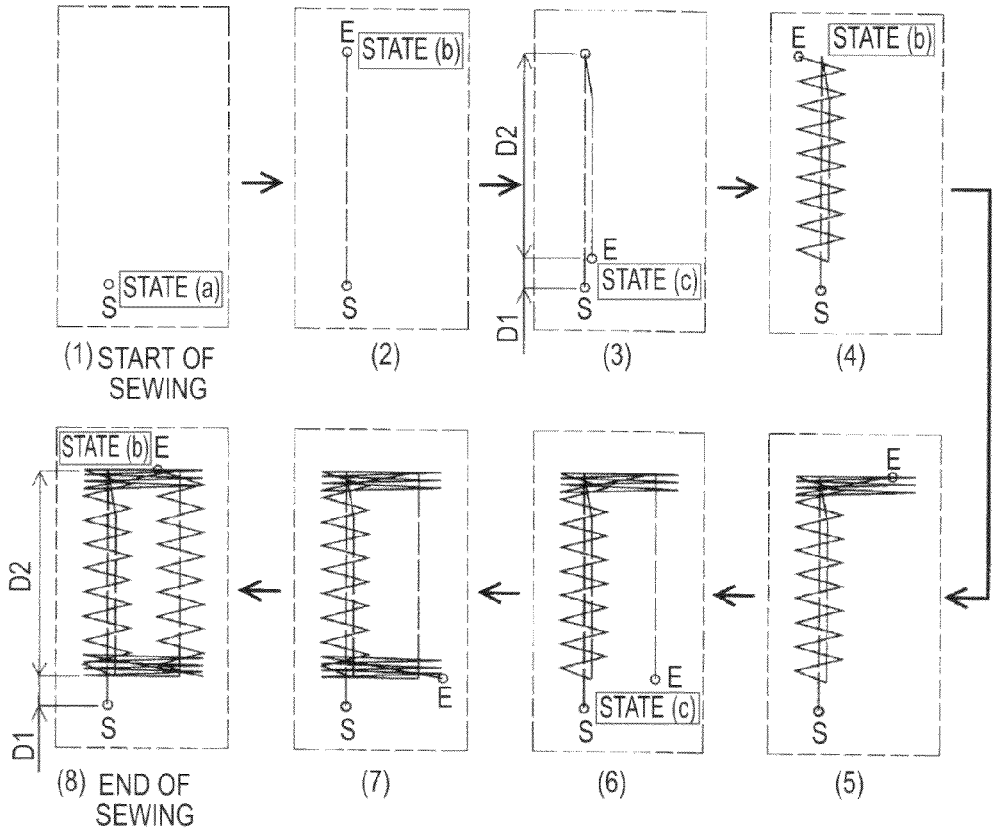
FIG. 10 is an explanatory view illustrating a buttonhole sewing procedure of the sewing machine equipped with the buttonhole switch mechanism of one embodiment disclosed here.
Figure 11A:
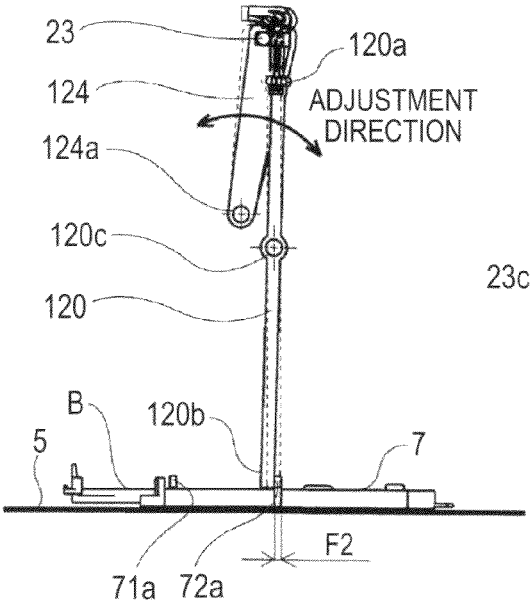
FIGS. 11A to 11C are side views schematically illustrating a buttonhole switch mechanism according to the related art.
Figure 11B:
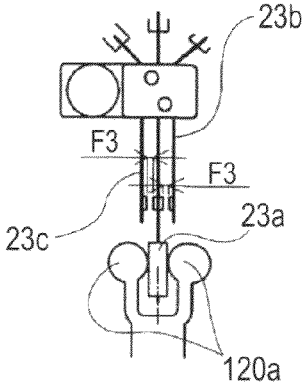
Figure 11C:
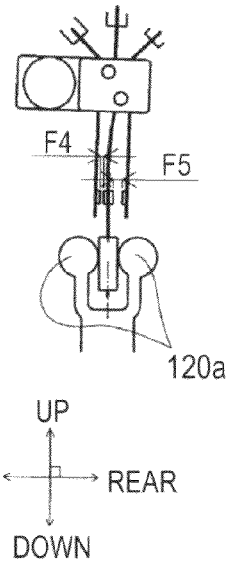
Figure 12A:
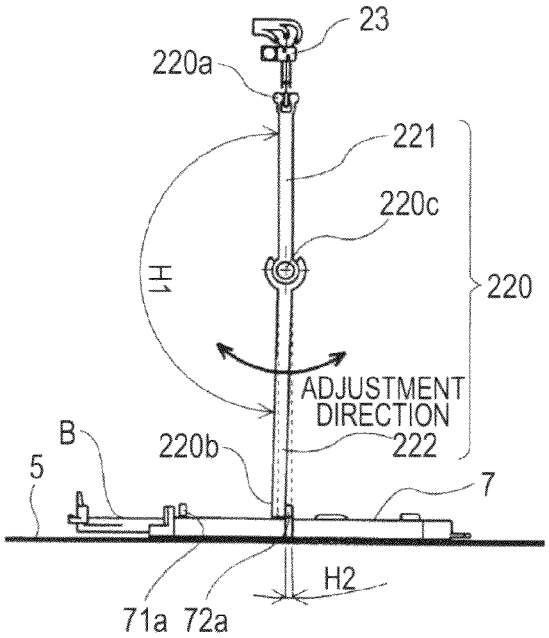
FIGS. 12A to 12C are side views schematically illustrating another buttonhole switch mechanism according to the related art.
Figures 12B, 12C:
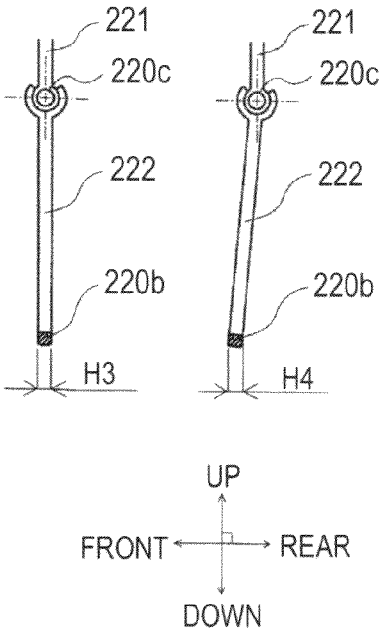

If the user pushes the start/stop switch 10 of the sewing machine main body to start the sewing machine, the buttonhole sewing is automatically performed in the order shown in (1) to (8) of FIG. 10. If the sewing machine starts in (1) (state (a) of FIG. 7A) of FIG. 10, the controller 8 controls a sewing machine drive motor 9*a* (shown in FIG. 9) to perform straight sewing while moving cloth rearward (the direction of X2 in FIGS. 7A to 7C) together with the buttonhole presser 7, by a cloth feed mechanism using the feed dog 6 of the sewing machine main body. Then, if the knob portion 21*b* of the buttonhole switching lever 21 contacts the lever operating arm 71*a* of the button diameter measurement member 71 in (2) (state (b) of FIG. 7B) of FIG. 10, the buttonhole switching arm 22 rotates the rotary shaft 24*a* in the counterclockwise direction at the supporting point, and the central contact 23*a* and the front contact 23*c* of the detection switch 23 are electrically connected by the switching operation portion 22*a* of the buttonhole switching arm 22 (shown in FIG. 8C). This is an input signal of a second buttonhole sensor shown in FIG. 9, and the controller 8 moves a feed mechanism stepping motor 9*b* to reverse the direction in which the cloth is fed to the front (the direction of X1 in FIGS. 7A to 7C).

In (3) (state (c) of 7C) of FIG. 10, similarly to the state (a) of FIG. 7A, the central contact 23*a* and the rear contact 23*b* of the detection switch 23 are electrically connected, and an input signal of the first buttonhole sensor shown in FIG. 9 is sent to the controller 8. The controller 8 moves the feed mechanism stepping motor 9*b* to reverse the direction in which the cloth is fed to the rear (the direction of X2 in FIGS.

7A to 7C). Then, in (4) of FIG. 10, the controller 8 alternately moves the sewing needle 4 in the right-and-left direction, using a swing width mechanism stepping motor 9*c*, to perform zigzag sewing. As the controller 8 controls the sewing machine drive motor 9*a*, the feed mechanism stepping motor 9*b*, and the swing width mechanism stepping motor 9*c* by the input signals of the first buttonhole sensor and the second buttonhole sensor shown in FIG. 9 in this way, the buttonhole sewing is automatically performed in the order shown in (1) to (8) of FIG. 10.

When the buttonhole sewing is completed, a beard-shaped pattern (sewing trace) equivalent to length D1 may be generated at the end of the sewing of (8) of FIG. 10, and the appearance of the buttonhole that is finished being sewn is deteriorated. This is because, in the state (a) of FIG. 7A, the push-in amount of the detection switch 23 when a user brings the knob portion 21*b* of the buttonhole switching lever 21 into contact with the lever operating arm 72*a* of the buttonhole presser 7 is excessive, whereas in the state (c) of FIG. 7C, the push-in amount of the detection switch 23 when the knob portion 21*b* automatically contacts the lever operating arm 72*a* becomes a requisite minimum. As a result, in the state (c) of FIG. 7C, as shown in (3) and (6) of FIG. 10, the direction in which the cloth is fed, at a timing immediately before the cloth returns to the state (a) at the start position, is reversed.

In order to solve the above problems, in a sewing machine manufacturing process, a manufacturer may adjust the electrical connection position of the detection switch 23 so that the excessive push-in amount of the detection switch 23 in the state (a) of FIG. 7A becomes equal to the requisite minimum push-in amount of the detection switch 23 in the state (c) of FIG. 7C. An adjustment procedure of the electrical connection position of the detection switch 23 in the present embodiment will be described with reference to FIGS. 5 to 7C. The manufacturer loosens the fixing screw 27 so as to bring a state where the mount 24 is movable in the front-and-rear direction with respect to the base plate 25. Then, the manufacturer operates to rotate the operating portion 26*c* of the adjustment dial 26, to move the mount 24, to which the buttonhole switching arm 22 and the detection switch 23 are attached, forward in parallel with respect to the base plate 25, to reduce a push-in amount G1 of the buttonhole switching lever 21.

In the present embodiment, as shown in FIG. 6, the position and travel distance of the mount 24 in the front-and-rear direction with respect to the base plate 25 can be recognized as numerical values by the combination between the scales 25*g* and the indicator 24*g*. Accordingly, the manufacturer can move the mount 24 to a suitable position simply by one rotational operation of the adjustment dial 26 by operating to rotate the operating portion 26*c* of the adjustment dial 26 while reading the scales 25*g*, to move the mount 24 forward in parallel (the direction of X1 in FIG. 5) with respect to the base plate 25 by the number of scales corresponding to the length D1, after the length D1 of the above-described beard-shaped pattern is measured by trial sewing before adjustment.

From the above, an excessive push-in amount A1 of the knob portion 21*b* of the buttonhole switching lever 21 in the state (a) of FIG. 7A can be reduced to make the push-in amount of the buttonhole switching lever 21 in the state (a) of FIG. 7A equal to a requisite minimum push-in amount C1 in the state (c) of FIG. 7C. Thereby, the push-in amount of the central contact 23*a* of the detection switch 23 in the state (a) of FIG. 7A can be made equal to the requisite minimum push-in amount of the central contact 23*a* of the detection switch 23 in the state (c) of FIG. 7C. Thereafter, the manufacturer fastens the fixing screw 27 to bring into a state where the mount 24 is immovable in the front-and-rear direction to the base plate 25, thereby completing the adjustment of the electrical connection position of the detection switch 23.

According to the present embodiment, since the buttonhole switch mechanism 2 is a mechanism in which the detection switch 23 and the lever member (the buttonhole switching lever 21 and the buttonhole switching arm 22) for operating the detection switch 23 are combined, the buttonhole switch mechanism is inexpensive as compared to the mechanisms using the sliding volume in the sewing machines disclosed in References 2 and 3.

Additionally, according to the buttonhole switch mechanism 2 of the present embodiment, the adjustment dial 26 and the fixing screw 27 that are the adjustment mechanism disclosed here are operated, so that the mount 24, in which the lever member and the detection switch 23 are integrally provided, can be relatively moved in the front-and-rear direction with respect to the base plate 25 fixed to the machine frame 1 that is a non-movable part of the sewing machine main body, and be fixed. That is, the adjustment mechanism is operated, so that the relative positions in the front-and-rear direction between the lever member and the detection switch 23, and the buttonhole presser 7 can be adjusted and fixed to perform the adjustment of the electrical connection position of the detection switch 23.

The adjustment mechanism that adjusts the electrical connection position of the detection switch 23 has the following advantages as the mount 24 in which the lever member and the detection switch 23 are integrally provided is moved in the front-and-rear direction in this way. First, even in a case where the amount of adjustment using the adjustment mechanism is large, the quality of buttonhole sewing is excellent because the timing at which a cloth feed direction is reversed is not shifted and the sewing length of a buttonhole is not influenced. Secondly, the adjustment range can be widely set because the positional relationship between the lever member and the detection switch 23 does not change before and after adjustment. Hence, an increase in manufacturing cost can be suppressed, without requiring excessively high dimensional precision of the sewing machine component parts and excessively high assembling precision of the sewing machine manufacturing process.

Thirdly, when the electrical connection position of the detection switch 23 is adjusted, the mount 24 may be moved in the front-and-rear direction by the adjustment dial 26 that is an adjustment mechanism by an amount equal to the amount of adjustment for adjusting the push-in amount of the lower end portion of the lever member to a normal push-in amount. Accordingly, according to the present embodiment, the adjustment of the electrical connection position of the detection switch 23 is simple and easy, and the number of times of repetition of adjustment by the manufacturer's trial and error can be minimized to suppress an increase in manufacturing cost. Additionally, since the adjustment of the electrical connection position of the detection switch 23 is simple and easy and adjustment by a skilled manufacturer becomes unnecessary, manufacturing costs can be reduced. Additionally, since the adjustment of the electrical connection position of the detection switch 23 by a user is also easy in a case where defects occur again in the electrical connection position of the detection switch 23 after use of the sewing machine, an aspect in which a user performs adjustment by himself/herself can also be adopted. The time and effort that are required to make a request to a maker or the like for repair of the sewing machine can be saved by doing so.

Additionally, according to the buttonhole switch mechanism 2 of the present embodiment, as the adjustment mechanism, the relative positions of the base plate 25 and the mount 24 in the front-and-rear direction are adjusted by the screw hole 24*e* provided to pass through in the front-and-rear direction of the mount 24 and the screw portion 26*a* (adjusting screw) of the adjustment dial 26 screwed into the screw hole 24*e*. Hence, according to the present embodiment, the relative positions of the base plate 25 and the mount 24 in the front-and-rear direction can be adjusted with a simple configuration.

Additionally, according to the buttonhole switch mechanism 2 of the present embodiment, the operating portion 26*c* provided at the adjustment dial 26 has a larger diameter than the screw diameter of the screw portion 26*a*. Therefore, a manufacturer or a user can operate the operating portion 26*c* with a small operation force to rotate the adjustment dial 26. Hence according to the present embodiment, the operativity of the adjustment dial 26 is excellent, and fine adjustment of the electrical connection position of the detection switch 23 is easy.

Additionally, according to the buttonhole switch mechanism 2 of the present embodiment, a manufacturer or a user can recognize the amount of adjustment, when changing the relative positions of the base plate 25 and the mount 24 in the front-and-rear direction, as numerical values by the scales 25*g* and the indicator 24*g*. Thereby, after defects in the sewing finish quality of a buttonhole are measured, the manufacturer or the user can adjust the relative positions of the base plate 25 and the mount 24 in the front-and-rear direction by the number of scales corresponding to the measurement value, thereby completing the adjustment of the electrical connection position of the detection switch 23. Hence, the number of times of repetition of adjustment by the manufacturer's trial and error can be minimized to once so as to suppress an increase in manufacturing cost to a maximum extent. Additionally, a user can rapidly and easily perform the adjustment of the electrical connection position of the detection switch 23 in a case where defects occur again in the electrical connection position of the detection switch 23 after use of the sewing machine.

It is needless to say that the buttonhole switch mechanism disclosed here is not limited to the above-described embodiment, and the invention can be carried out in various forms subjected to changes, improvements, or the like that can be performed by a person skilled in the art, without departing from the scope disclosed here.

For example, in the present embodiment, the relative positions of the base plate 25 and the mount 24 in the front-and-rear direction are adjusted by the screw hole 24*e* provided to pass through in the front-and-rear direction of the mount 24 and the screw portion 26*a* (adjusting screw) of the adjustment dial 26 screwed into the screw hole 24*e*. However, the configuration of the adjustment mechanism is not limited to this. A configuration may be adopted in which the base plate is formed with a screw hole provided to pass through in the front-and-rear direction and an adjusting screw rotatably held on the mount is screwed into this screw hole. Additionally, the mount is formed with a screw hole of a normal screw and the base plate is formed with a screw hole of a reverse screw, and both of the screw holes can be coupled by an adjusting screw that has a thread of the normal screw formed on one end and a thread of the reverse screw formed on the other end. Additionally, an adjusting screw of a normal screw is fixed to the mount and an adjusting screw of a reverse screw is fixed into the fixing member, and both the adjusting screws can be coupled by an adjusting nut that has a screw hole of the normal screw formed at one end and a screw hole of the reverse screw formed at the other end.

Additionally, in the present embodiment, the adjustment mechanism that is operated by operating to rotate the operating portion 26*c* of the adjustment dial 26 around an axis in the front-and-rear direction. However, the configuration of the adjustment mechanism is not limited to this. For example, it is also easy for a person skilled in the art to adopt an adjustment mechanism that is operated by the operating portion that rotates around an axis in the right-and-left direction, using power transmission mechanisms, such as a rack & pinion, a link mechanism, or a cam mechanism.

Additionally, in the present embodiment, the mount 24 is provided with the indicator 24*g* and the base plate 25 is provided with the scales 25*g*. However, a configuration can also be adopted in which the base plate is provided with indicator and the mount is provided with the scales.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A buttonhole switch mechanism of a buttonhole sewing machine comprising:

a buttonhole presser mounted on a lower end of a presser bar of the sewing machine and having a presser frame that is movable in a front-and-rear direction with respect to the presser bar, and two projection portions that are provided side by side in the front-and-rear direction at an interval according to the diameter of a button and move integrally with the presser frame;

a buttonhole switch mechanism disposed on an arm section of the sewing machine and having a detection switch of which contacts are electrically connected when the presser frame is located on the foremost side and when the presser frame is located on the rearmost side;

a feed dog disposed below the buttonhole presser to move cloth, which is an object to be sewn, in the front-and-rear direction at a predetermined feed pitch in cooperation with the presser frame;

a sewing needle forming stitches in the cloth with vertical movement and adapted to be movable in a right-and-left direction;

a controller performing control on the movement of the feed dog and the sewing needle on the basis of the electrical connection of the detection switch of the buttonhole switch mechanism;

a fixing member fixed to a non-movable part of a sewing machine main body;

a mount supported so as to be movable in the front-and-rear direction with respect to the fixing member;

an adjustment mechanism adjusting and fixing the relative positions of the fixing member and the mount in the front-and-rear direction;

a lever member supported by a rotary shaft provided at the mount so as to be rotatable in the front-and-rear direction and being capable of extending a lower end portion between both the projection portions of the buttonhole presser an adjustment dial provided between the fixing member and the mount, which is rotated to adjust a push-in amount between a buttonhole switching lever and the detection switch by moving the mount forward in parallel with respect to the fixing member while scales provided on one of the fixing member and the mount in the front-and-rear direction and an indicator combined with the scales on the other one of the fixing member and the mount are read; and the detection switch fixed to the mount and electrically connected as the lower end portion of the lever member is pushed and rotated by each projection portion.

2. The buttonhole switch mechanism according to claim 1, wherein the adjustment mechanism adjusts the relative positions of the fixing member and the mount in the front-and-rear direction by a screw hole provided to pass through in the front-and-rear direction and an adjusting screw screwed into the screw hole.

3. The buttonhole switch mechanism according to claim 2, wherein the adjusting screw is provided with an operating portion having a larger diameter than the screw diameter of the adjusting screw.

4. The buttonhole switch mechanism according to claim 1, wherein the scales in the front-and-rear direction are on the fixing member, and the indicator is on the mount.

* * * * *